US005562073A

United States Patent [19]

Van Bezeij et al.

[11] Patent Number: 5,562,073

[45] Date of Patent: Oct. 8, 1996

[54] CYLINDER BLOCK HAVING A GRAY IRON BASE BLOCK SURROUNDED BY AN ALUMINUM SHELL

[75] Inventors: Nico J. Van Bezeij, Stiphout/Helmond, Netherlands; Rolf Gosch, Wels-Thalheim, Austria

[73] Assignee: Eisenwerk Brühl GmbH, Brühl, Germany

[21] Appl. No.: 509,341

[22] Filed: Jul. 31, 1995

[30] Foreign Application Priority Data

Aug. 5, 1994 [DE] Germany ..... 9412637 U

[51] Int. Cl.[6] ..... F02F 7/00

[52] U.S. Cl. ..... 123/193.2; 123/195 R

[58] Field of Search ..... 123/193.2, 193.1, 123/195 R, 195 H, 41.74

[56] References Cited

U.S. PATENT DOCUMENTS

| | | | |
|---|---|---|---|
| 4,446,827 | 5/1984 | Kubozuka | 123/195 R |
| 4,938,183 | 7/1990 | Field et al. | 123/193.2 |
| 5,357,922 | 10/1994 | Han | 123/195 R |

FOREIGN PATENT DOCUMENTS 4231284 3/1994 Germany .

*Primary Examiner*—Marguerite McMahon
*Attorney, Agent, or Firm*—Spencer & Frank

[57] ABSTRACT

A cylinder block for an internal-combustion engine includes a cast gray iron base block having, as integral, one-piece components therewith, a cylinder sleeve, a crankshaft bearing bracket and an engine foot. The cylinder block further has an aluminum shell surrounding the base block and having a portion constituting a water jacket in a shell zone adjoining the cylinder sleeve.

9 Claims, 2 Drawing Sheets

CYLINDER BLOCK HAVING A GRAY IRON BASE BLOCK SURROUNDED BY AN ALUMINUM SHELL

CROSS REFERENCE TO RELATED APPLICATION

This application claims the priority of German Application No. G 94 12 637.2 filed Aug. 5, 1994, which is incorporated herein by reference.

BACKGROUND OF THE INVENTION

This invention relates to a cylinder block for a piston-type internal combustion engine.

The weight of piston engines, particularly engines for passenger vehicles, is sought to be reduced to the greatest possible extent. For this purpose cylinder blocks made of light metal have been manufactured. In such cylinder blocks, however, two different materials have to be used, since the cylinder sleeves which accommodate the respective pistons, still have to be made of gray cast iron of appropriate quality.

German Offenlegungsschrift (application published without examination) 42 31 284 discloses a cylinder block made of gray cast iron which is so configured that, on the one hand, a weight reduction is achieved and, on the other hand, it has a high form-retaining strength. This rigidity is essentially achieved by providing cross-sectionally U-shaped reinforcing ribs on the two outer sides of the water jacket between any two cylinders. The ribs extend to the zone of the crankshaft bearing bracket, so that forces which are generated between the cylinder head and the crankshaft bearing and which are to be absorbed by the cylinder block are taken up primarily by the reinforcing ribs. As a result, all other wall portions may be made appreciably thinner.

SUMMARY OF THE INVENTION

It is an object of the invention to provide an improved gray iron cylinder block of the above-outlined type wherein the weight of the cylinder block is further reduced without adversely affecting the configurational strength.

This object and others to become apparent as the specification progresses, are accomplished by the invention, according to which, briefly stated, the cylinder block comprises a base block which is a single-piece gray iron structure integrally including at least one cylinder sleeve, a support bracket for the crankshaft bearing and an engine foot. The cylinder block further comprises an aluminum shell which surrounds the base block and which, in the zone of the cylinder sleeves, has a double-wall construction to function as a water jacket.

In a conventional cylinder block made entirely of gray iron, for example, vermiculite, a wall thickness cannot be less than 4 mm for reasons of casting technology and thus no further weight reduction by reducing the wall thickness is possible. In contrast, the cylinder block according to the invention has the advantage that while the components exposed to stress during engine operation are still made of gray iron as the base block, other engine components, such as at least the water jacket in the vicinity of the cylinder sleeves, are incorporated in the aluminum shell which is provided around the base block in a second casting step after installing the appropriate cores in the base block. The construction according to the invention has the advantage that the force flow between the cylinder head and the engine foot progresses, as before, in its entirety in the gray iron component. Thus, the cylinder sleeves, the crankshaft bearing brackets as well as the engine foot constitute a one-piece gray iron structure.

A weight reduction as compared to conventional engines is achieved by the fact that the components forming the shell, particularly the water jacket which has to withstand only the pressure of the coolant, may be made with reduced wall thicknesses between 2 and 3 mm and are of aluminum. In addition to the water jacket, the shell may also extend over that zone of the cylinder block which in the region of the crankshaft bearing bracket forms the housing wall for the crankcase so that there too, a desired weight reduction may be achieved. The continued use of gray iron for the cylinder sleeves according to the invention has the advantage that gray iron has a superior anti-friction property important in that environment.

By virtue of the fact that the shell is united with the base block in a casting process there is obtained, with an appropriate temperature control during the casting process, a superior, tight bond between the aluminum shell and the gray iron base block.

According to an advantageous feature of the invention, the portion of the shell which constitutes the water jacket is double-walled and the part which constitutes the inner wall lies directly on the cylinder sleeve (or cylinder sleeves in case of a multicylinder engine block) and the part which constitutes the outer wall extends at a distance therefrom. This arrangement is advantageous in that the pressurized coolant cannot penetrate in the boundary zone between the aluminum shell and the gray iron base block so that sealing problems are avoided from the outset. The pressurized coolant is thus surrounded exclusively by closed, cast aluminum walls extending into the zone of the coolant inlets and outlets.

In accordance with a further advantageous feature of the invention, in case of a multicylinder engine block, in the common gray iron wall portion of two adjoining cylinder sleeves at least one transverse opening is provided which is filled by the cast aluminum of the water jacket. This arrangement has the advantage that even between the two adjoining cylinders, the walls of the water jacket engaging the base block are integrally connected with one another and thus an inner anchoring of this portion of the shell is obtained. It is a further advantage of this feature that because of the improved heat conductivity, even from the region between immediately adjoining cylinder sleeves, an additional heat conduction through the aluminum webs passing through the openings is achieved and thus the cooling effect is improved in such zone which normally can be cooled only with great difficulty, if at all. Expediently, the transverse opening has a slot-like contour.

According to still another feature of the invention, the base block and the shell are, at least in the transitional zone between the cylinder sleeve and the crankshaft bearing bracket, connected by interengaging ridges and grooves extending parallel to the crankshaft axis. This arrangement has the advantage that not only a form-locking anchoring between the aluminum shell and the gray iron base block is ensured but, in addition, a labyrinth-like seal is obtained so that a passage of a liquid medium, whether coolant or oil, from a space defined by this zone is prevented.

According to still another feature of the invention, starting from the transitional zone between the cylinder sleeve and the crankshaft bearing bracket, the lower zone of the base block is surrounded by a cast aluminum housing wall forming the crankcase of the engine. As an additional feature of the invention, the housing wall forms an integral part of the shell which also defines the water jacket. By thus providing a housing wall which outwardly screens the crankshaft and which is of aluminum instead of gray iron (which is readily feasible, since the housing wall performs no load-carrying function) a further possibility of weight reduction is obtained. The change of material from gray iron to aluminum in this zone too, results in a significant weight reduction. By making the housing wall in a casting process, it is feasible to provide, on the outer and/or inner side, stiffening ribs which, without appreciable weight increase, reinforce the housing wall resulting in a suppression of vibration and/or droning phenomena. It is further expedient to have the housing wall extend down to the engine foot and to surround and reach under the same. In this manner, a form-locking connection is obtained between the gray iron engine foot (forming part of the base block) and the aluminum shell, so that residual stresses which may be generated by the cooling process of the casting step, do not lead to a separation of the shell in this zone.

DESCRIPTION OF THE PREFERRED EMBODIMENT

Figure 1:
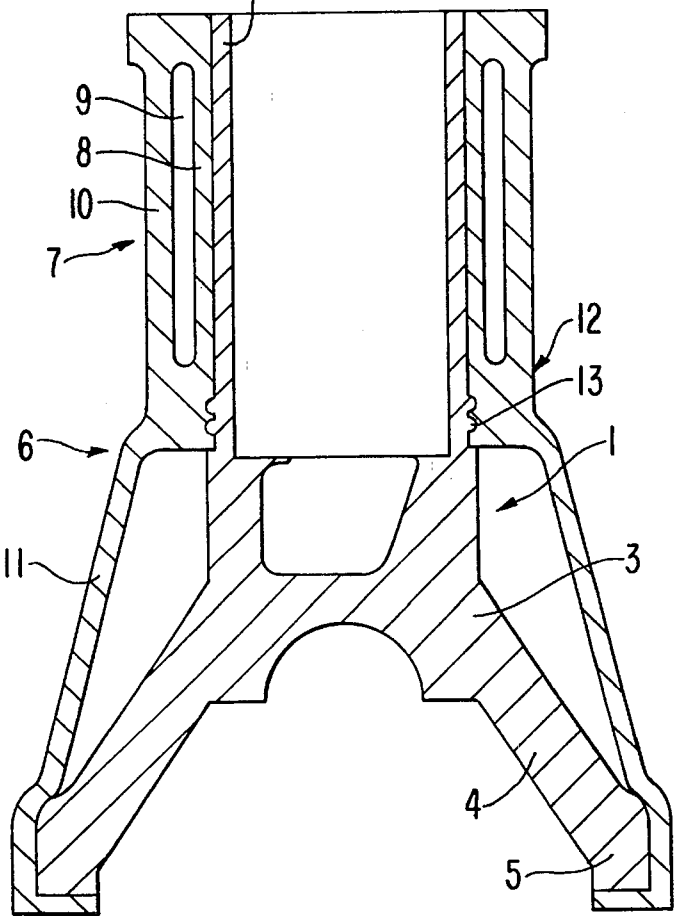
FIG. 1 is a sectional view of a preferred embodiment, taken partially along line I—I and II—II of FIG. 3.

FIG. 1 shows a vertical section through a cylinder block of a multicylinder, in-line internal combustion engine. The cylinder block is essentially formed of a base block 1 which is cast from gray iron, such as a vermiculite (GGV) and which, as integral components, includes cylinder sleeves 2 as well as web-like crankshaft bearing brackets 3 positioned between any two adjoining cylinder sleeves 2. The bearing brackets 3 have web-like struts 4 terminating in the engine foot 5. The sectional plane is perpendicular to the crankshaft axis and first passes vertically through the entire length of a cylinder sleeve 2 and thereafter continues between two cylinder sleeves, passing through a bearing bracket and its struts 4. The base block 1 is surrounded by an aluminum shell 6 which is provided around the base block 1 in a second casting process after positioning appropriate cores. The shell 6 forms a water jacket 7 in the region which immediately surrounds the cylinder sleeves 2. The part of the shell 6 which constitutes the water jacket 7 is of dual wall construction so that the inner wall 8 bounding the space 9 (water duct) engages directly the outer surface of the cylinder sleeves 2 while the outer wall 10 bounds the water jacket space 9 from the outside.

At the lower end of the water jacket 7 the shell 6 continues as a housing 11 which closes off downwardly the lower engine zone and which forms the crank casing.

In the transitional zone 12 between the water jacket 7 and the housing 11 the base block 1 is provided on its outer face with a longitudinally extending rib or rib series 13 which interlocks with a similar configuration on the inner face of the shell 6, obtained while casting the latter about the base block 1. Thus, in this manner, a groove-and-rib type form-fitting connection between the base block 1 and the shell 6 is obtained. The housing 11, in its lower portion, surrounds the engine foot 5 and reaches thereunder and thus in this region too, the shell 6 is form-fittingly engaging the base block 1.

Figure 2:
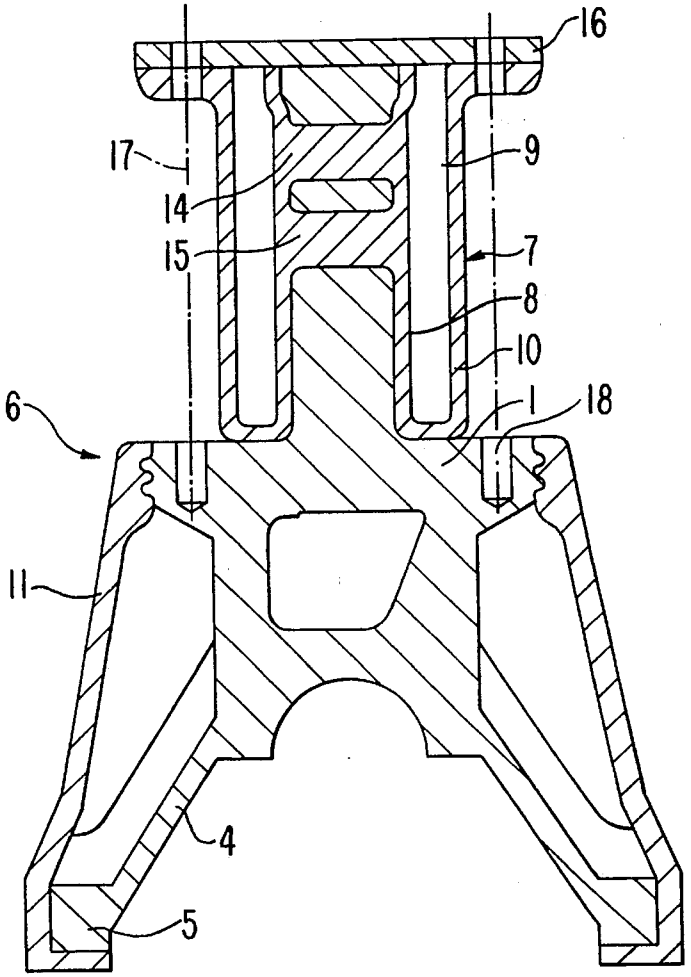
FIG. 2 is a sectional view taken along line II—II of FIG. 3.
Figure 3:
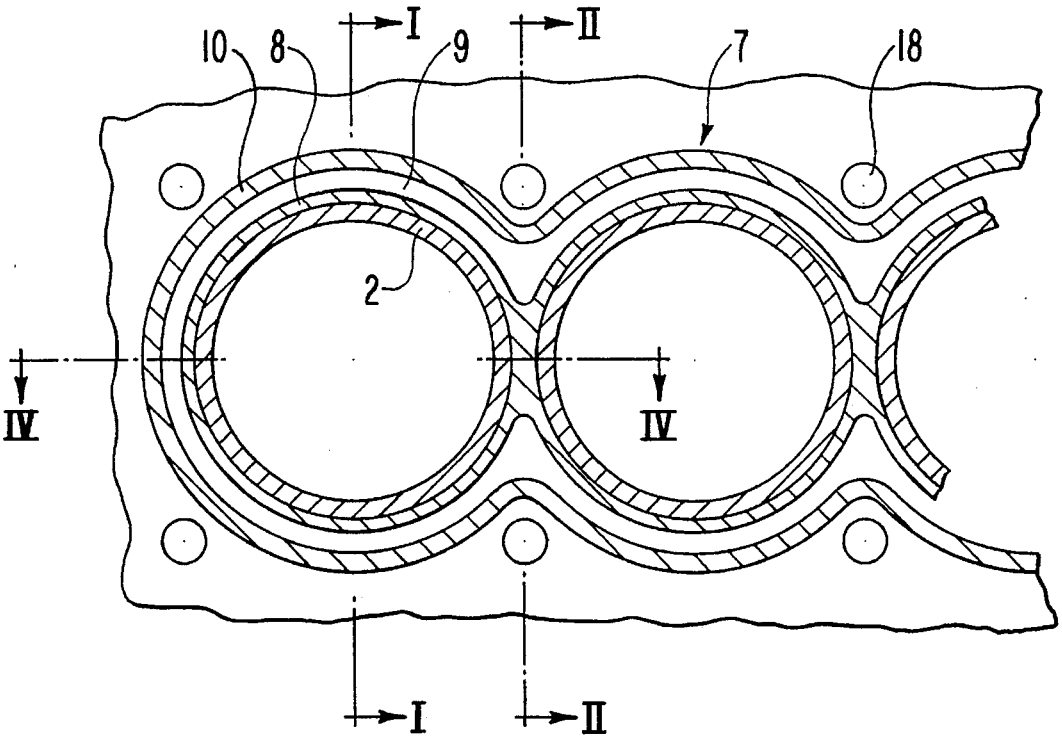
FIG. 3 is a sectional view taken along line III—III of FIG. 4.
Figure 4:
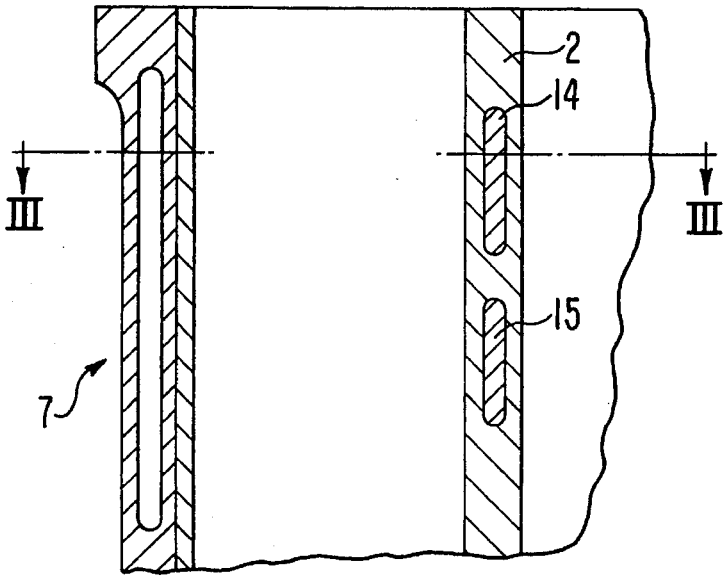
FIG. 4 is a sectional view taken along line IV—IV of FIG. 3.

While the illustration in FIG. 1 is a vertical section containing an axis of a cylinder sleeve 2, the illustration in FIG. 2 is a sectional view taken between two adjoining cylinder sleeves 2, parallel to and spaced from their cylinder sleeve axes. This engine block region is also illustrated in FIGS. 3 and 4. The narrow connecting zone of the base block 1 between two adjoining cylinder sleeves 2 is traversed by two narrow, slot-like transverse openings 14 and 15 at a level of the upper region of the cylinder sleeves 2. As seen in FIG. 4, the openings 14 and 15 have a cross-sectional area of elongated shape. When the aluminum jacket 6 is cast around the base block 1, the molten aluminum fills the transverse openings 14, 15 so that the inner walls 8 of the water jacket 7 oriented to one another in this region are integrally connected and are thus also affixed (anchored) to the base block 1. It is a further advantage of this arrangement that the aluminum webs in this region provide for a better heat removal to the water jacket 7 because of the greater heat conductivity of aluminum as compared to the gray iron base block 1.

The cylinder head 16, only schematically shown in FIG. 2, is directly tightened to the base block 1 by bolts 17 shown only by their longitudinal axes. The shell 6 has, in this region, a cutout portion which is provided either during casting or is obtained subsequently upon drilling the thread bores 18 for receiving the bolts 17.

It will be understood that the above description of the present invention is susceptible to various modifications, changes and adaptations, and the same are intended to be comprehended within the meaning and range of equivalents of the appended claims.

What is claimed is:

1. A cylinder block for an internal-combustion engine, comprising (a) a cast gray iron base block including, as integral, one-piece components therewith, a cylinder sleeve, a crankshaft bearing bracket and an engine foot; and (b) an aluminum shell surrounding said base block and having a portion constituting a water jacket in a shell zone adjoining said cylinder sleeve.

2. The cylinder block as defined in claim 1, wherein said shell is cast about and anchored to said base block.

3. The cylinder block as defined in claim 1, wherein said shell has, in said shell zone, an inner wall directly engaging an outer surface of said cylinder sleeve and an outer wall extending spaced from said inner wall; said inner and outer walls together define said water jacket.

4. The cylinder block as defined in claim 1, further comprising a region of transition between said cylinder sleeve and said crankshaft bearing bracket; and interengaging portions of said base block and said shell in said region of transition; said interengaging portions being formed of a mutually nesting groove-and-rib assembly extending parallel in a longitudinal direction of said engine block; said longitudinal direction being defined by the crankshaft axis in the predetermined position of the crankshaft in the cylinder block.

5. The cylinder block as defined in claim 1, further comprising a cast aluminum crankcase surrounding a lower region of said base block downwardly from a transitional zone between said cylinder sleeve and said crankshaft bearing bracket.

6. The cylinder block as defined in claim 5, wherein said cast aluminum crankcase forms an integral part of said shell.

7. The cylinder block as defined in claim 5, wherein said crankcase surrounds and reaches underneath said engine foot.

8. A cylinder block for an internal-combustion engine, comprising (a) a cast gray iron base block including, as integral, one-piece components therewith, a crankshaft bearing bracket, an engine foot and a plurality of cylinder sleeves; said base block having a portion defining a common wall of two immediately adjoining said cylinder sleeves; said portion having a throughgoing transverse opening; and (b) an aluminum shell surrounding said base block and having a portion constituting a water jacket in a shell zone adjoining said cylinder shell; said aluminum shell having an integral part passing through said transverse opening in said base block, whereby said shell is anchored to said base block.

9. The cylinder block as defined in claim 8, wherein said opening has a cross-sectional area of elongated shape.

* * * * *

UNITED STATES PATENT AND TRADEMARK OFFICE

CERTIFICATE OF CORRECTION

PATENT NO. : 5,562,073

DATED : October 8, 1996

INVENTOR(S) : Nico Johan van Bezeij et al

It is certified that error appears in the above-indentified patent and that said Letters Patent is hereby corrected as shown below:

On the title page, item [73], the assignee should read --Eisenwerk Brühl Gmbh, Brühl, Germany and VAW mändl & berger GmbH, Linz, Austria.--.

Signed and Sealed this

Ninth Day of September, 1997

*Attest:*

*Attesting Officer*

Bruce Lehman

BRUCE LEHMAN

*Commissioner of Patents and Trademarks*